US006134790A

United States Patent [19]

Watson

[11] Patent Number: 6,134,790

[45] Date of Patent: Oct. 24, 2000

[54] UTENSIL FOR CHILDREN

[75] Inventor: Curtis G. Watson, Delray Beach, Fla.

[73] Assignee: Play It Safe, Inc., Boca Raton, Fla.

[21] Appl. No.: 09/108,630

[22] Filed: Oct. 5, 1998

Related U.S. Application Data

[60] Provisional application No. 60/051,404, Jul. 1, 1997.

[51] Int. Cl.[7] ..... A47J 43/28

[52] U.S. Cl. ..... 30/326; 30/295

[58] Field of Search ..... 30/149, 146, 147, 30/148, 150, 322, 323, 324, 325, 326, 327, 328, 295; 54/12; D7/150, 656; 128/9

[56] References Cited

U.S. PATENT DOCUMENTS

| | | | |
|---|---|---|---|
| 1,501,020 | 7/1924 | Small | 30/295 |
| 2,028,519 | 1/1936 | Peterkin et al. | 30/324 |
| 2,787,055 | 4/1957 | Wertz | 30/295 |
| 2,789,349 | 4/1957 | Lee | 30/295 |
| 2,853,780 | 9/1958 | Bull | 30/295 |
| 3,858,320 | 1/1975 | Neal et al. | 30/326 |
| 4,380,122 | 4/1983 | Jagger | 30/295 |
| 4,719,702 | 1/1988 | Hoffman | 30/326 |
| 4,785,796 | 11/1988 | Mattson | 128/9 |
| 4,976,646 | 12/1990 | Hull | 446/74 |
| 5,479,708 | 1/1996 | Thomas | 30/324 |
| 5,774,921 | 7/1998 | Harrison et al. | 15/145 |

*Primary Examiner*—Rinaldi Rada
*Assistant Examiner*—Omar Flores-Sánchez
*Attorney, Agent, or Firm*—Plunkett & Cooney, P.C.

[57] ABSTRACT

A utensil for infants and toddlers it includes a planar flexible handle portion and a semi-rigid utensil portion. The utensil portion includes a ridge and a handle which engages the handle portion. A mouth guard is included and is disposed at the junction of the handle and handle portion. Included among the utensils are a spoon, fork and toothbrush. A kit of utensils is, also, disclosed.

12 Claims, 3 Drawing Sheets

FIG 1
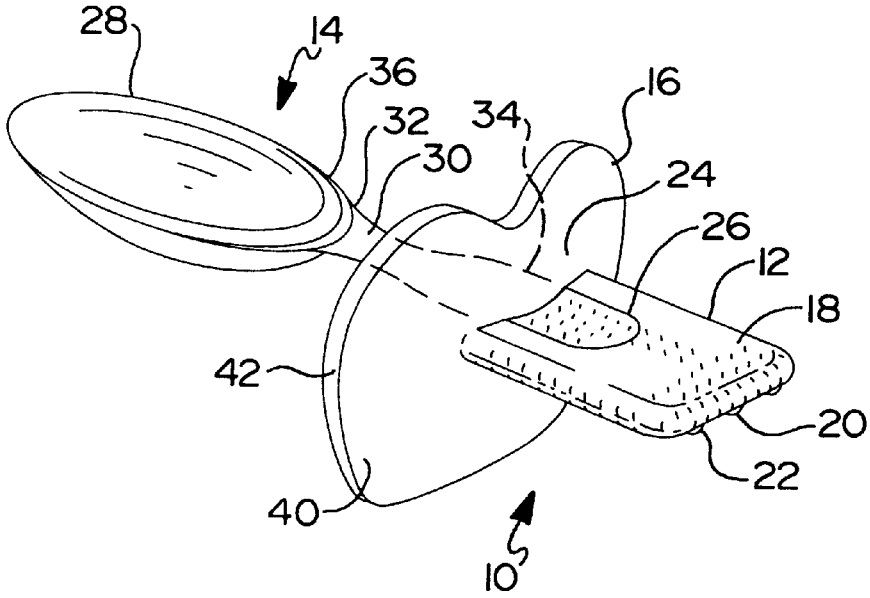
FIG 2
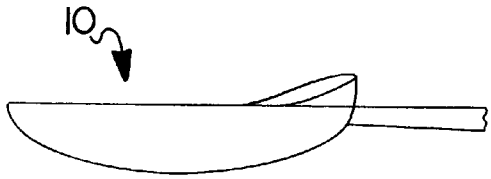
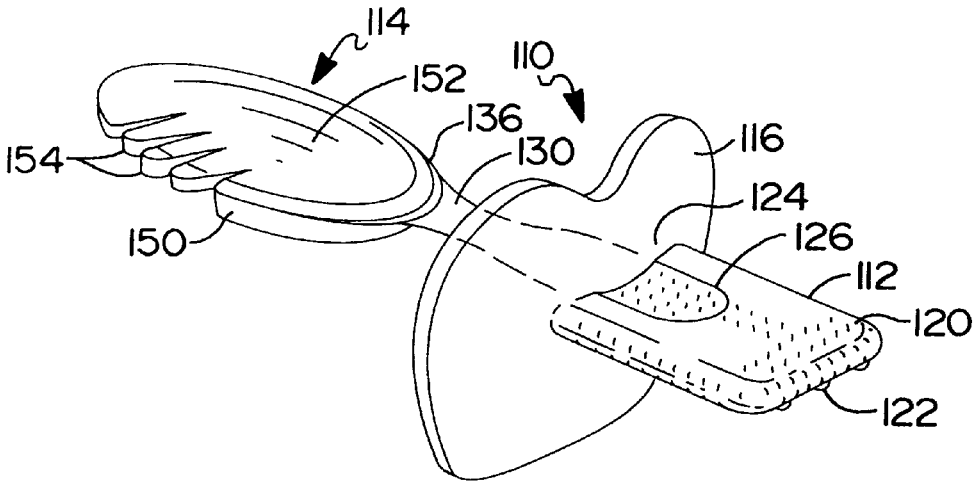
FIG 4

FIG 3
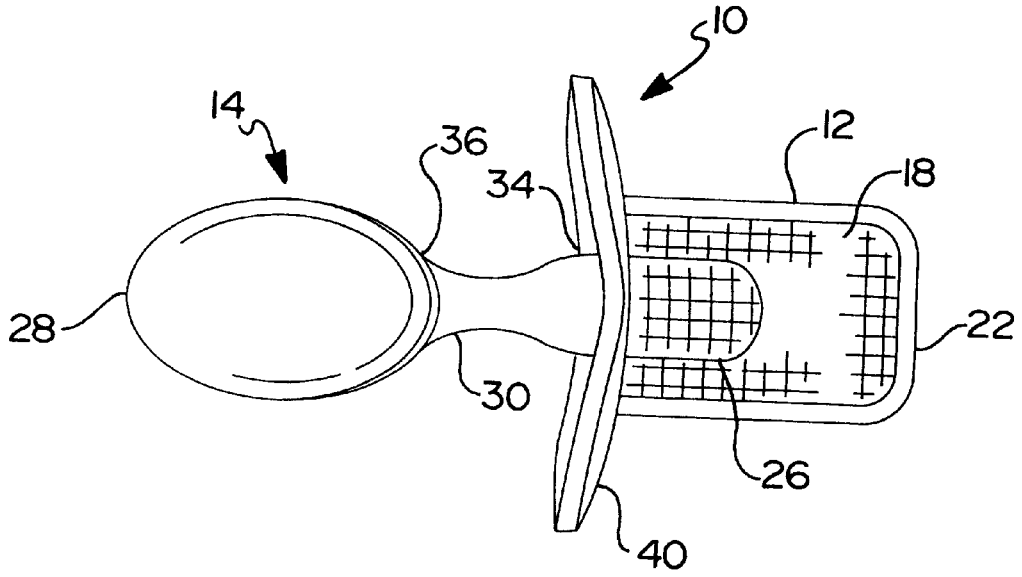
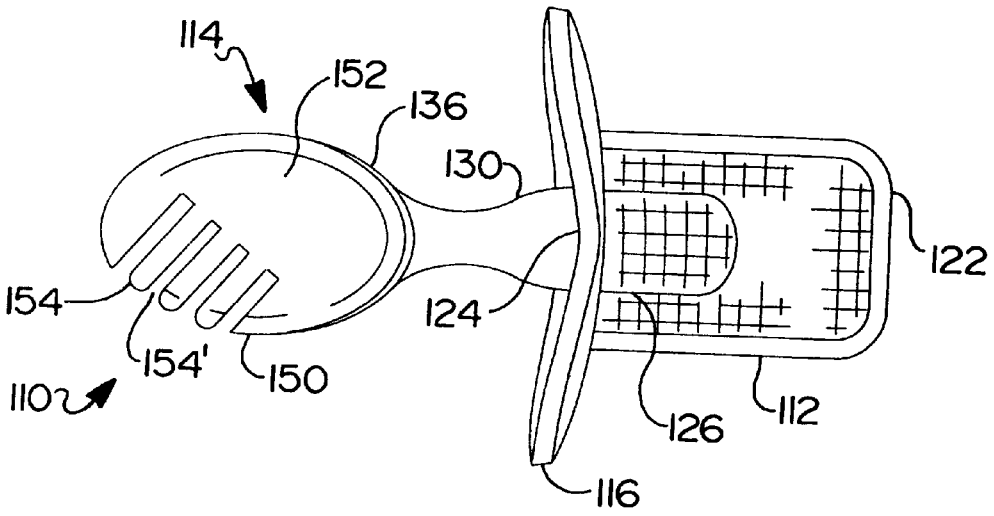
FIG 5

FIG 7
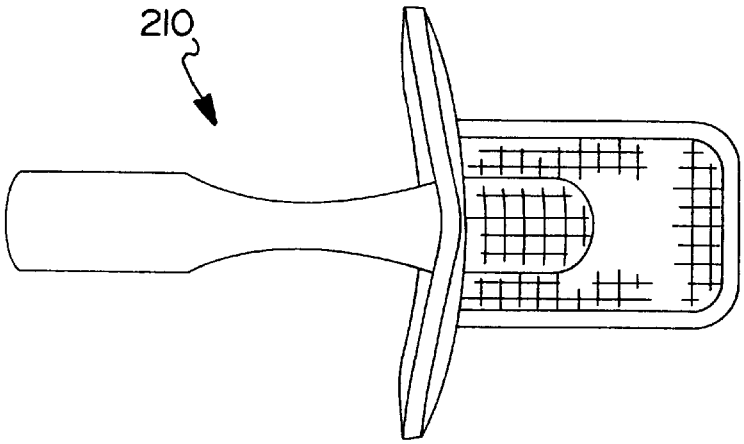
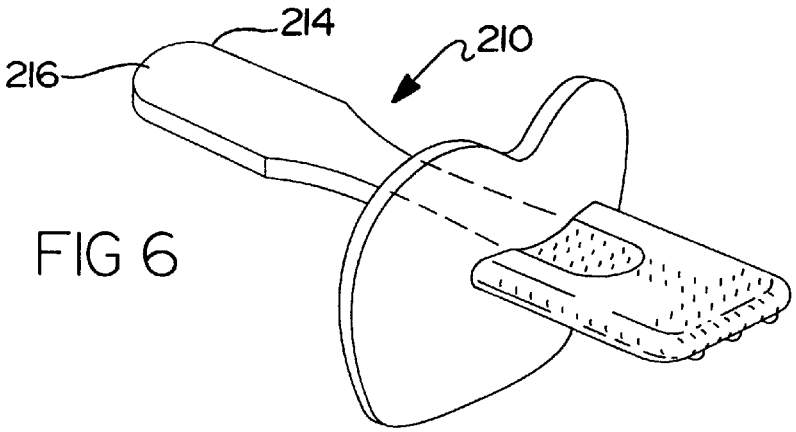
FIG 6
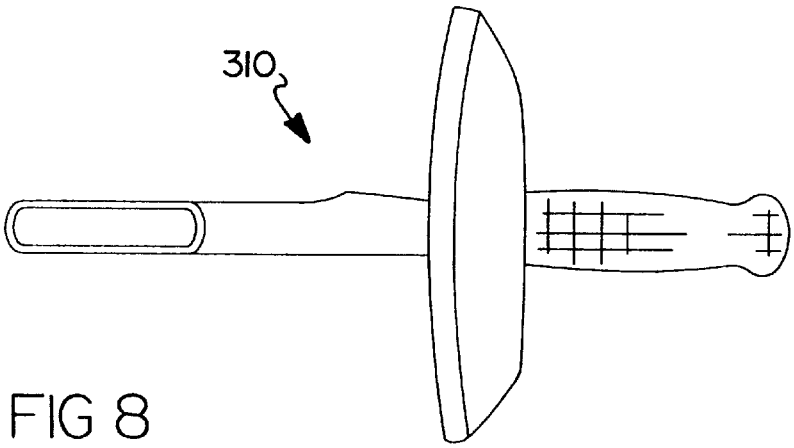
FIG 8

UTENSIL FOR CHILDREN

CROSS REFERENCE TO RELATED APPLICATIONS

This application is a completion application of co-pending U.S. Provisional Application 60/051,404, filed Jul. 1, 1997 for "Utensil For Children", the disclosure of which is hereby incorporated by reference.

STATEMENT REGARDING FEDERALLY SPONSORED RESEARCH

Not applicable.

BACKGROUND OF THE INVENTION

1. Prior Art

It is to be appreciated that one of the major constraints to the utilization of an infant utensil is the potential for injury to the child. As detailed hereinbelow, because of the materials of construction employed herewith the utensil is not only safe but cannot be accidentally swallowed. Moreover, because of the unique configuration of the utensil portion of the device is also defines a teaching utensil in that it teaches the child to utilize, properly, the utensil associated therewith.

Known prior art infant utensils of which applicant is aware, simply do not preclude accidental swallowing while at the same time, teaching the proper utilization thereof. For example, in U.S. Pat. No. 5,479,708, there is disclosed an infant's utensil which includes a handle having a utensil supporting portion which enables interchangability of various utensils. While the device thereof may teach proper grasping or facilitate grasping by an infant, it does not preclude the accidental swallowing thereof.

Therefore, it is to be appreciated that there exists a need for an infant's or a child's utensil which not only enables proper gripping and teaching, but prevents potential injury to the child through the swallowing thereof. It is to this to which the present invention is directed.

2. Field of the Invention

The present invention concerns utensils for children. More particularly, the present invention concerns a "safe" or child safety utensil. Even more particularly, the present invention concerns means and methods for producing a utensil for use by children which is safe and easy to use.

SUMMARY OF THE INVENTION

Thus, and in accordance herewith, there is provided an infant or child safe utensil which, generally, comprises:

(a) a flexible handle portion;

(b) a utensil portion, and (c) a mouth guard to prevent accidental swallowing.

The mouth guard may be integral with either the handle, the utensil or maybe an element distinct and separate from either the handle or utensil portion and maybe slidably mounted thereonto.

Each of the components hereof is made from a non-toxic material.

The present invention, further, contemplates interchangable utensils such as a child's fork, spoon or brush, be it a hairbrush or toothbrush or the like.

For a more complete understanding of the present invention reference is made to the following detailed description and accompanying drawings. In the drawing like reference characters refer to like parts throughout the several views in which:

BRIEF DESCRIPTION OF THE DRAWING

FIG. 1 is a perspective view of a first embodiment of a utensil for a child in accordance with the present invention;

FIG. 2 is a partial side elevational view of the utensil hereof;

FIG. 3 is a top plan view thereof;

FIG. 4 is a perspective view of a second embodiment hereof;

FIG. 5 is a top plan view of the embodiment of FIG. 4;

FIG. 6 is a perspective view of a third embodiment hereof;

FIG. 7 is a top plan view of the third embodiment hereof, and

FIG. 8 depicts a modification of the third embodiment hereof

DESCRIPTION OF THE PREFERRED EMBODIMENT

As noted hereinabove the present invention provides an infant or child safe utensil which, generally, comprises:

(a) a flexible handle portion;

(b) a utensil portion removably mounted to the handle portion, and (c) a mouth guard mounted to the handle to prevent accidental swallowing of the utensil.

It is to be appreciated that one of the major constraints to the utilization of an infant utensil is the potential for injury to the child. As detailed hereinbelow, because of the materials of construction employed herewith the utensil is not only safe but cannot be accidentally swallowed. Moreover, because of the unique configuration of the utensil portion of the device is also defines a teaching utensil in that it teaches the child to utilize, properly, the utensil associated therewith.

More particularly, and with reference to FIGS. 1, 2 and 3 there is depicted therein a first embodiment of the present invention and which is, generally, denoted at 10. The device 10 includes a handle portion 12, a utensil end 14 and a mouth guard 16 mounted onto the utensil end at the junction thereof with the handle portion therebetween.

The handle portion 12 is dimensioned of sufficient size to enable grasping thereof by an infant or small child. The handle has an outer surface 18 which is knurled around the periphery thereof, as at 20, to facilitate the grasping thereof. The handle portion 12 is formed from any suitable flexible material such as polyethylene, polypropylene, silicone rubber or other material that can be flexed to prevent injury to an infant in the event of accidental contact therewithin.

The handle portion 12 has a first end 22 and a second opposite end 24. An elongated slot or opening 26 is formed at the end 24 and extends into the interior of the handle, thus, defining a partial bore or the like. As detailed hereinbelow, the partial bore 26 is utilized to secure the utensil end 14 to the handle.

According to the embodiment of FIG. 1, the utensil portion defines a spoon member and includes a spooning portion 28 which is a convex member having an elliptical or otherwise configured dish or basin element 29 having a peripheral ledge 31 formed therearound, which enables the spooning of liquids, soft foods and the like thereinto. A handle 30 is integrally formed with the concave member and projects therefrom. As shown in FIG. 1, the handle 30 has a first end 32 which is integrally formed with the spooning portion 28 and a second or opposite end 34 which projects into the bore 26. The end 34 is secured within the partial bore 26 by any suitable means such as by gluing, sonic welding, heat bonding or the like. Alternately, the end 34 may be removably secured within the bore 26 by friction. This enables interchangeability of the utensil portion of the device 10. Preferably, the utensil portion 14 is formed from a semi-rigid material to preclude accidental injury or the like.

As shown in FIG. 2, the convex member or spooning portion is provided with an upstanding ridge 36 which partially extends about the periphery or peripheral ledge 31 of the convex portion 28, proximate the first end of the handle 30. The ridge 36 tapers from being substantially co-planar with the convex portion to a medial or mid-highest portion which, then, tapers downwardly to a diametrically opposed position on the ledge 31, as shown. The ridge 31 defines a spill or splash guard to prevent the flow of foodstuffs therepast.

The present device or utensil further includes a guard or mouth guard 16 to prevent accidental swallowing or the like. The guard 16 comprises a substantially planar member 40 formed of the same soft pliable material as the handle portion 12. The guard 34 has a central slot 42 to enable the guard to be slid over the handle and emplaced at the junction between the handle portion 34 and the end 24 of the handle portion and is positioned substantially normal or perpendicular thereto.

The guard may be provided with an arcuate configuration for the device to conform to the curvature of the mouth portion of an infant or a small child. Thus, if the infant were to insert the entire utensil portion into its mouth the guard prevents passage past the lips and, if gotten therepast prevents swallowing. The guard may be either removably mountable to the utensil so that it can be used in other environments or, alternatively, the guard may be fixed in place through any suitable mode, such as by gluing, sonic welding, heat bonding or the like.

Referring now to FIGS. 4 and 5, there is depicted therein an alternate embodiment of the present invention and which is generally denoted at 110. Herein, all of the elements are the same, including the handle portion 112, the mouth guard portion 116, the handle 130, the bore 126, the handle having a first end 122 and a opposite end 124, as well as the knurling 120, which parallels the elements of the first embodiment. Additionally, there is the splash or spill guard 136 which is similar to the guard 36 in the first embodiment. Herein, though, the utensil end, generally, denoted at 114 comprises a fork like member having a concave elliptical body 150 having a peripheral ledge 131. The body 150 defines a shell having a concave interior 152. The concave body 150 has a plurality of discontinuities 154, 154', etc., formed therein and which extends inwardly from the ledge toward the center of the interior 152. These discontinuities or serrations define tines such that the utensil becomes a fork. It is to be noted with respect hereto that the tines, which are substantially parallel to each other, are angularly inclined along the horizontal axis with respect to the longitudinal axis of the utensil, per se, and intersects with the longitudinal axis. The intersection with the longitudinal axis may be at any convenient angle. One such convenient angle is 30°. However, it is to be understood that the intersection with the longitudinal axis may be at any convenient angle, including flat (i.e. 0°) if desired. By having the horizontal angular skewing the opportunity for an infant to be stabbed by the tines is minimized. Furthermore, tines are provided with blunt ends or rounded ends as a further safety feature.

It is to be further noted that the ends of each tine lies along the same arc as the balance of the shell and does not extend therebeyond to, again, preclude any injury to the child.

In all other respects, this embodiment is similar to the embodiment of FIG. 1.

Turning now to FIGS. 6 and 7, there is depicted therein a further embodiment of the present invention and, generally, denoted at 210. Herein, the child's utensil takes on a definition of a brush and includes both the handle portion, the guard, as well as the utensil end. In all respects, this embodiment is configured similar to that of the first two embodiments except that the utensil end carries a brush element 214 including a header 216 having a plurality of bristles (not shown) secured thereto and depending therefrom. The bristles may comprise bristles for brushing teeth or for brushing hair.

In FIG. 8, there is depicted therein still a modification of the third embodiment of the present invention wherein the handle is of a reduced diameter handle to facilitate by an even younger infant. The reduced handle portion may be deployed in connection with the other embodiments hereof.

Where friction is used to retain the utensil end in position, a plurality of utensil ends may be interchangeably mounted onto the handle portion so that only a single handle need be employed. Likewise, removable mounting of the mouth guard enhances the interchangeability and compactness of the device.

It is to be appreciated from the preceding that there has been described herein a child's utensil which is safe to use while providing adequate training to teach the child how to utilize the utensil. Furthermore, it is apparent because of the materials of construction and the disposition of the guard that the utensil cannot be swallowed or accidental lodged within the mouth of the infant.

In fabricating the present utensil it is fabricated from non-toxic materials of any well known type.

It is further contemplated that the present invention be defined by a kit including the handle and a plurality of the interchangable utensil portions such as hereinabove described.

Having, thus, described the invention what is claimed is:

1. A utensil for use by infants and toddlers, comprising:

(a) a substantially flat planar flexible handle portion, having a longitudinal axis, (b) a semi-rigid utensil portion, (1) an elliptical basin element, the basin having a major axis and a minor axis, the element having a peripheral ledge therearound, (2) an upstanding ridge disposed on and which extends upwardly from the periphery of the ledge and partially about the periphery of the ledge, the ridge tapering from a high point and merging into the ledge, the ridge defining a splash guard, (3) a handle extending from the basin element and disposed proximate the high point of the ridge, the handle having a longitudinal axis, the handle engaging the flexible handle portion at a junction thereof, the handle having a longitudinal axis;

(c) an arcuate planar mouth guard dispose at the junction, and rearwardly of the ridge the mouth guard conforming to the curvature to the mouth of an infant or toddler, and wherein, the flexible handle portion, the handle and the major axis are coaxial.

2. The utensil of claim 1 wherein the utensil portion is removably mounted to the handle portion.

3. The utensil of claim 2 wherein:

(a) the handle portion has a first end and a second end, one end having an elongated slot formed therein which defines a partial bore extending into the interior of the handle, and (b) the utensil portion comprising a handle, the handle projecting into and being frictionally retained within the partial bore.

4. The utensil of claim 1 wherein the mouth guard comprises:

(a) a substantially planar member having a slot formed therein, the mouth guard being slidably mounted onto the flexible handle by projecting the handle portion through the elongated slot.

5. The utensil of claim 2, wherein the utensil portion comprises a spoon.

6. The utensil of claim 5 wherein:

the upstanding ridge tapers from a peak downwardly to the ledge, the ridge defining a splash guard.

7. The utensil of claim 1 wherein the utensil portion is a fork.

8. The utensil of claim 7 wherein the fork comprises a plurality of tines formed in the basin, each of the tines having a curved end.

9. The utensil of claim 1 wherein further comprises:

a plurality of tines cut-out from the basin, each of the tines having a longitudinal axis which intersects the major axis of the basin at an angle greater than 0°.

10. The utensil of claim 9 wherein the utensil portion is a brush.

11. A utensil kit for use by an infant or toddler comprising:

(a) a substantially flat planar flexible handle portion, the handle portion including a utensil receiving end, (b) a plurality of interchangeable utensil portions, each utensil portion having a member which is removably received by the utensil receiving portion of the handle, at least one of the utensil portions of the kit comprising:

(1) an elliptical basin element, the basin having a manor axis and a minor axis, the element having a peripheral ledge therearound, (2) an upstanding ridge disposed on and which extends upwardly from the periphery of the ledge and partially about the periphery of the ledge, the ridge tapering from a high point and merging into the ledge, the ridge defining a splash guard, (3) a handle extending from the basin element and disposed proximate the high point of the ridge, the handle having a longitudinal axis, the handle engaging the flexible handle portion at a junction thereof, the handle having a longitudinal axis;

(c) an arcuate planar mouth guard disposed at the junction, and rearwardly of the ridge the mouth guard conforming to the curvature of the mouth of an infant or toddler, and wherein, the flexible handle portion, the handle and the major axis are coaxial.

12. The kit of claim 11 wherein the mouth guard comprises a substantially elongated planar member having a slot formed therein, the slot enabling the mouth guard to be slid onto the handle.

* * * * *